US008601838B2

(12) United States Patent
Hansen et al.

(10) Patent No.: US 8,601,838 B2
(45) Date of Patent: Dec. 10, 2013

(54) LOCKING MECHANISM

(75) Inventors: Wayne Hansen, Poynette, WI (US); Curtis J. Scadden, Waunakee, WI (US); Robert A. Bergum, Woodstock, IL (US); Pravin E. Lokhande, Maharashtra (IN)

(73) Assignee: Knaack LLC, Crystal Lake, IL (US)

( * ) Notice: Subject to any disclaimer, the term of this patent is extended or adjusted under 35 U.S.C. 154(b) by 146 days.

(21) Appl. No.: 13/205,752

(22) Filed: Aug. 9, 2011

(65) Prior Publication Data

US 2012/0305565 A1 Dec. 6, 2012

(30) Foreign Application Priority Data

Jun. 6, 2011 (IN) ..... 1658/MUM/2011

(51) Int. Cl.
*E05B 67/38* (2006.01)

(52) U.S. Cl.
USPC ..... 70/56; 70/159; 292/126; 220/326; 49/395; 312/107.5; 312/215; 312/218

(58) Field of Classification Search
USPC ..... 70/54–56, 159, 164; 292/126, 219, 220, 292/195, DIG. 21, DIG. 30, DIG. 61; 220/326; 49/395; 312/107.5, 215, 216, 312/218, 220, 109, 326
See application file for complete search history.

(56) References Cited

U.S. PATENT DOCUMENTS

| | | | | |
|---|---|---|---|---|
| 2,188,703 | A * | 1/1940 | Burke | 70/82 |
| 2,227,803 | A * | 1/1941 | Bales | 70/264 |
| 4,290,281 | A | 9/1981 | Knaack et al. | |
| 4,742,701 | A * | 5/1988 | Scavetto | 70/121 |
| 6,681,604 | B1 | 1/2004 | Samsel | |
| 6,772,613 | B2 * | 8/2004 | Webb et al. | 70/159 |
| 6,883,274 | B2 * | 4/2005 | Webb et al. | 49/293 |
| 7,318,632 | B2 | 1/2008 | Bidinger et al. | |
| 7,370,890 | B2 | 5/2008 | Samsel | |
| 7,418,846 | B2 * | 9/2008 | James et al. | 70/159 |
| 7,823,741 | B2 | 11/2010 | Bridges et al. | |
| 7,909,419 | B2 * | 3/2011 | Vinke | 312/215 |
| 8,342,580 | B2 * | 1/2013 | Cowie et al. | 292/32 |
| 2002/0108410 | A1 * | 8/2002 | Webb et al. | 70/159 |
| 2005/0056062 | A1 * | 3/2005 | Gogel | 70/56 |
| 2006/0022561 | A1 | 2/2006 | Bidinger et al. | |
| 2007/0240462 | A1 * | 10/2007 | James et al. | 70/159 |
| 2008/0110893 | A1 * | 5/2008 | Cowie et al. | 220/324 |
| 2008/0223091 | A1 * | 9/2008 | Kroening et al. | 70/78 |
| 2010/0212376 | A1 | 8/2010 | Wagh et al. | |

OTHER PUBLICATIONS

International Search Report for International Application No. PCT/US2012/037413 mailed Sep. 19, 2012.

* cited by examiner

*Primary Examiner* — Suzanne Barrett
(74) *Attorney, Agent, or Firm* — McDonnell Boehnen Hulbert & Berghoff LLP

(57) ABSTRACT

A locking mechanism for a storage container is provided. The locking mechanism is positioned on a center post of the storage container and includes a sled, a handle or knob, a connecting mechanism, a sled arresting mechanism, and a lock. Depending upon the position of the lock, the handle can unlatch the container. When the lock is in the unlocked position, the sled arresting mechanism allows the unlatching of the container. When the lock is in the locked position, the sled arresting mechanism prevents the unlatching of the container. The locking mechanism is resistant to drill attack due to its vertical configuration and positioning of a cover on the center post.

28 Claims, 24 Drawing Sheets

LOCKING MECHANISM

CROSS REFERENCE TO RELATED APPLICATIONS

This application claims priority to Indian application No. 1658/MUM/2011, filed on Jun. 6, 2011.

FIELD

The present application generally relates to methods and apparatuses for locking Particularly, the present invention relates to a vertical locking mechanism.

BACKGROUND

A lock is a mechanical or an electronic device for restricting access to an enclosed property. More specifically, the lock is adapted to protect against forced and surreptitious entry to the enclosed property or the particular area. The lock may be used on a door, a vehicle, a container such as a storage box or the like. The lock may be locked and unlocked by using a key, a keycard, RFID signal, or by inputting a key code.

Generally, storage boxes, such as jobsite storage boxes, industrial storage boxes, house hold storage boxes or the like, include vertical lock systems. Presently, the vertical lock systems include a padlock placed in a horizontal position with a key hole in an uncovered position. Such arrangements of the padlock and the key hole make the prior art vertical lock system vulnerable to drill attack. Further, as an actuating knob of the existing vertical lock system is directly connected to the padlock, a person trying to break-in can apply positive force onto the padlock using the actuation knob, in a locked configuration of the padlock, to unlock it or break it open.

For example, U.S. Pat. No. 7,823,741 discloses a container with a locking system. However, the container with locking system of the U.S. Pat. No. 7,823,741 is vulnerable to drill attack. Additionally, since the handle of the locking system of the U.S. Pat. No. 7,823,741 is directly connected to the padlock, a person trying to break-in can apply positive force onto the padlock using the handle, in a locked configuration of the padlock, to unlock it or break it open.

Furthermore, U.S. Patent Publication 2010/0212376 discloses a locking system for a storage container. The locking system for a storage container includes a padlock or other similar type of lock that is located within the container. However, the locking system for a storage container disclosed in U.S. Patent Publication 2010/0212376 is inefficient and fails to prevent breaking forces from reaching the padlock by knob actuation. More particularly, no means are provided for dampening the breaking forces reaching the padlock, thereby preventing damage to the padlock.

Accordingly, there is a need for a locking mechanism that is resistant to drill attack. Further, there is a need for a locking mechanism that precludes application of positive force on a padlock by means of an actuation knob, in a locked configuration of the padlock. There is also a need for a locking mechanism that is easy to use and that provides improved security.

SUMMARY

In accordance with one aspect of the present invention, a locking mechanism for use in a storage container having a center post is provided. The locking mechanism includes an actuator coupled to the center post and to the sled, a sled disposed on the center post and operatively coupled to the actuator, a connecting mechanism for connecting the actuator to the sled, a lock positioned on the center post, the lock capable of being locked and unlocked, and a sled arresting mechanism operatively coupled to the sled and allowing movement of the sled on the center post when the lock is unlocked. The actuator is capable of moving the locking mechanism from a locked position where access to the storage container is prevented, to an unlocked position in which access to the storage container is allowed. When the lock is unlocked and the actuator is moved in a vertical direction, the sled moves in the same direction as the actuator, moving the sled arresting mechanism in a horizontal direction toward the lock, which causes the latch rod to unlock the storage container.

In one embodiment, the lock is a padlock having a shackle and a key insertion surface. The connecting mechanism includes a bracket coupled to the actuator, a fastener connecting the bracket to the sled, and a spring disposed on the fastener. Further, the sled arresting mechanism includes a cam coupled to the sled and a sled arresting element secured to the cam. The sled arresting element allows movement of the sled on the center post when the lock is unlocked. The locking mechanism further includes a latch rod disposed on the sled being configured to engage with door catches on the storage container in the locked configuration of the storage container.

In another embodiment, the storage container includes a center post, a floor, upright side walls, a rear wall extending upwardly from the floor, and a ceiling attached to the side walls and rear wall. The floor, side walls, rear wall, and ceiling of the storage container define a storage cavity. A locking mechanism, such as the locking mechanism described above, is positioned on the center post of the storage container.

Alternatively, in another embodiment, the connecting mechanism includes a vertical rod and a nut and a washer assembly. The vertical rod is operatively connected to the sled and the actuator. The vertical rod has a stopper disposed at an operative lower end thereof. The stopper is adapted to facilitate lifting of the sled. The vertical rod is connected to the actuator substantially away from a fixed pivot end of the actuator. The spring is disposed on a top end of the vertical rod. The nut and washer assembly is disposed on a top end of the vertical rod above the spring. The spring is disposed between the actuator and the nut and the washer assembly.

Alternatively, in yet another embodiment, the connecting mechanism includes a vertical rod and a nut and a washer assembly. The vertical rod is operatively connected to the sled and the actuator. The vertical rod has a stopper disposed at a lower end thereof. The stopper is adapted to facilitate lifting of the sled. The vertical rod is connected to the actuator substantially away from a free end of the actuator. The spring is disposed on a top end of the vertical rod. The nut and washer assembly is disposed on a top end of the vertical rod above the spring, wherein the spring is disposed between the actuator and the nut and the washer assembly.

BRIEF DESCRIPTION OF THE DRAWINGS

The invention will now be explained in relation to the accompanying drawings, in which.

DETAILED DESCRIPTION

The invention will now be described with reference to the accompanying drawings which do not limit the scope and ambit of the invention. The description provided is purely by way of example and illustration. The block diagram and the description hereto are merely illustrative and only exemplify the invention and in no way limit the scope thereof.

Figure 1:
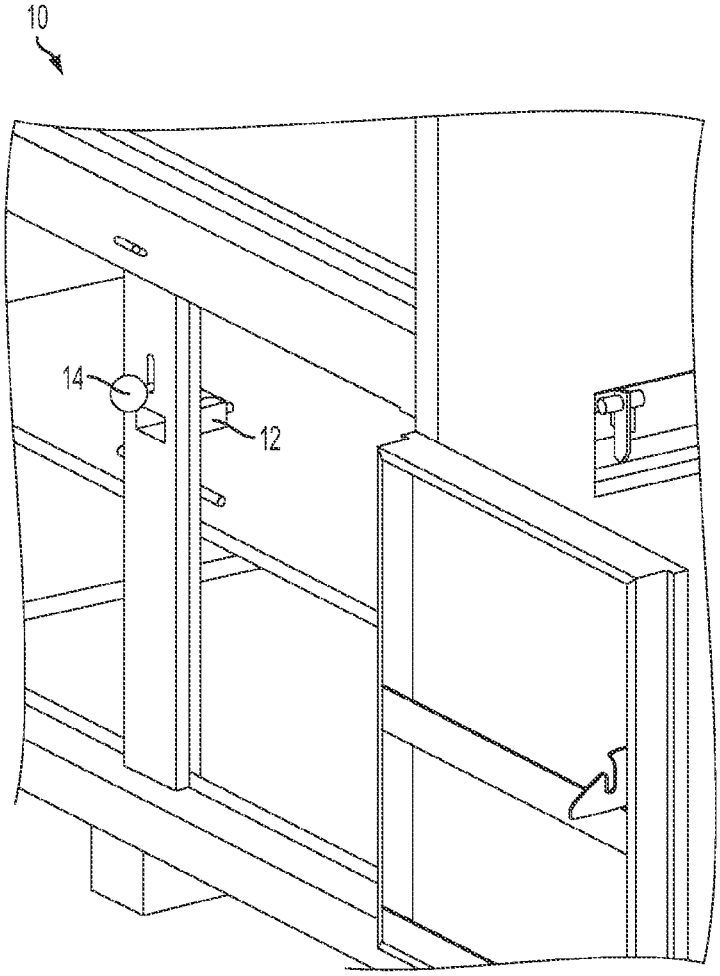
FIG. 1 PRIOR ART
FIG. 1 illustrates a perspective view of a storage box embodying a prior art vertical lock.
Figure 2:
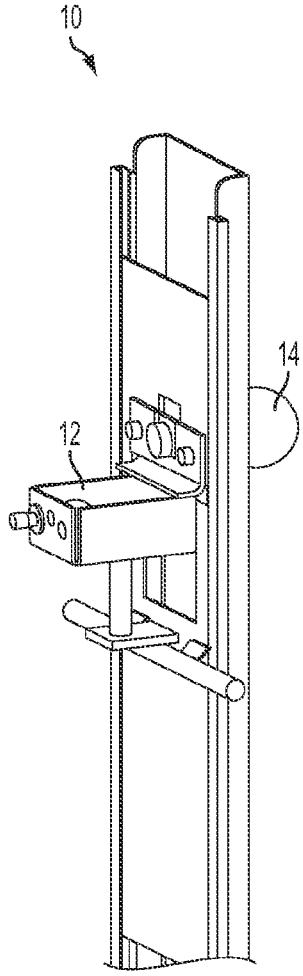
FIG. 2 PRIOR ART
FIG. 2 illustrates a perspective view of the prior art vertical lock as shown in FIG. 1.

Referring to FIGS. 1 and 2, a prior art vertical lock system 10 is disclosed. The vertical lock system 10 includes a padlock disposed in a housing 12 and an actuation knob 14. The padlock is placed in a horizontal position with a key insertion surface facing outwardly in an uncovered position. Since the padlock is placed in the horizontal position and the key insertion surface is in the uncovered position, the prior art vertical lock system 10 is vulnerable to drill attack. Further, because the actuating knob 14 of the existing vertical lock system 10 is directly connected to the padlock, a person trying to break-in can apply positive force onto the padlock, using the actuation knob 14, in a locked configuration of the padlock.

Accordingly, referring to FIGS. 3 to 25, locking mechanisms in accordance with various embodiments of the present invention are disclosed to alleviate the problems and limitations of prior art vertical lock systems. The locking mechanism of the present invention is adapted to provide comparatively more secured restricted access to an enclosed property or storage container, such as but not limited to jobsite storage boxes, industrial storage boxes, or household storage boxes, for example. The locking mechanism of the present invention is resistant to drill attack. Also, the knob of the locking mechanism of the present invention precludes application of positive force on the padlock in a locked configuration of the padlock.

Referring to FIGS. 3 to 8, a locking mechanism 100 is disclosed in accordance with one embodiment of the present invention. The locking mechanism 100 is positioned on a center post 102 of a storage container 116, such as the storage container shown in FIGS. 4 and 8. Alternatively, the center post 102 may be secured to a frame of the storage container. The storage container further includes a floor, upright side walls, a rear wall extending upwardly from the floor, and a ceiling attached to the side walls and rear wall. The floor, side walls, rear wall, and ceiling of the storage container define a storage cavity. In another embodiment, the storage container may have more than one storage cavity.

The locking mechanism comprises a sled 104, an actuator, such as a knob 106, a connecting mechanism 108, a sled arresting mechanism including a cam 110 and a sled arresting element 112, and a padlock 114. The locking mechanism 100 is disposed along a closing edge of a hinged door, a sliding door or any other kind of door of a storage container. More specifically, the locking mechanism 100 is preferably disposed at a top portion of the closing edge of the door. However, it should be understood that the present invention is not limited to a particular position of the locking mechanism 100 along the closing edge of the door.

The sled 104 is adapted to be slidingly disposed on the center post 102. The knob 106 is operatively coupled to the center post 102 and the sled 104. In one embodiment, the knob 106 is operatively connected to the center post 102 by a knob fastener or knob bolt 118 and a bracket 122. The knob 106 is adapted to move upward and downward within a slot 120 (shown in FIG. 4) configured on the center post 102. The knob 106 is adapted to actuate the sled 104 when the locking mechanism 100 is in an unlocked configuration.

The connecting mechanism 108 is coupled to the knob 106 and the sled 104. The connecting mechanism 108 is adapted to facilitate reciprocal, or upward and downward, movement of the sled 104 on the center post 102 in an unlocked configuration of the locking mechanism 100. The connecting mechanism 108 includes the bracket 122, a fastener 124, and a spring 126. In one embodiment, the fastener 124 is a bolt. Alternatively, it should be understood that any suitable fastener 124 may be used. The bracket 122 is coupled to the knob 106 by the knob bolt 118. The fastener 124 is adapted to connect the bracket 122 to the sled 104. In one embodiment, the fastener 124 is connected to the bracket 122 by welding. However, the present invention is not limited to any particular joining method used for connecting the fastener 124 to the bracket 122.

Figure 3:
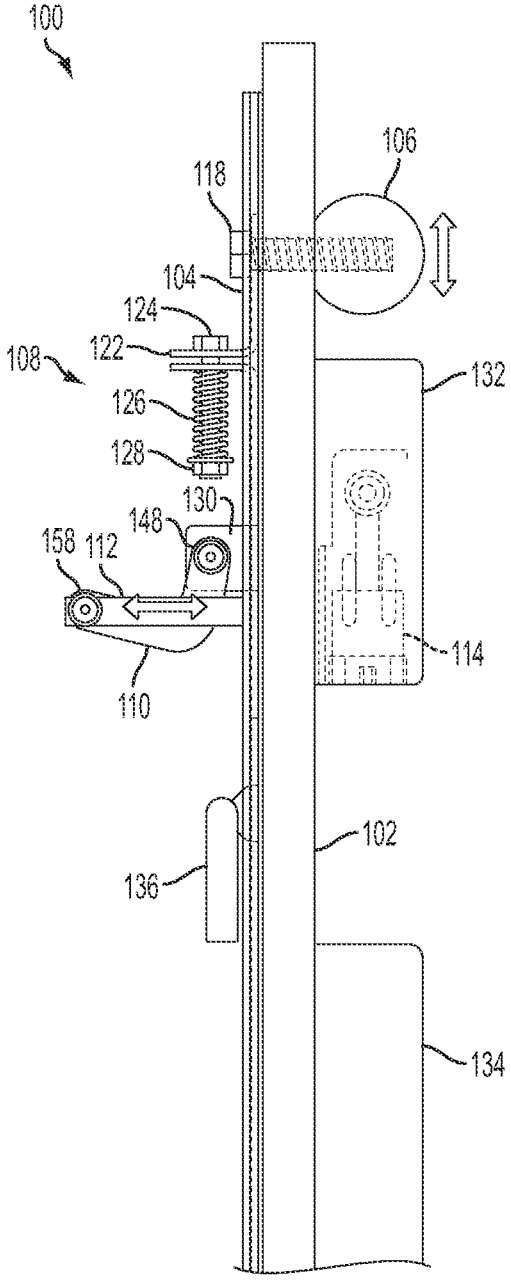
FIG. 3 illustrates a side view of a locking mechanism, in accordance with one embodiment of the present invention.
Figure 4:
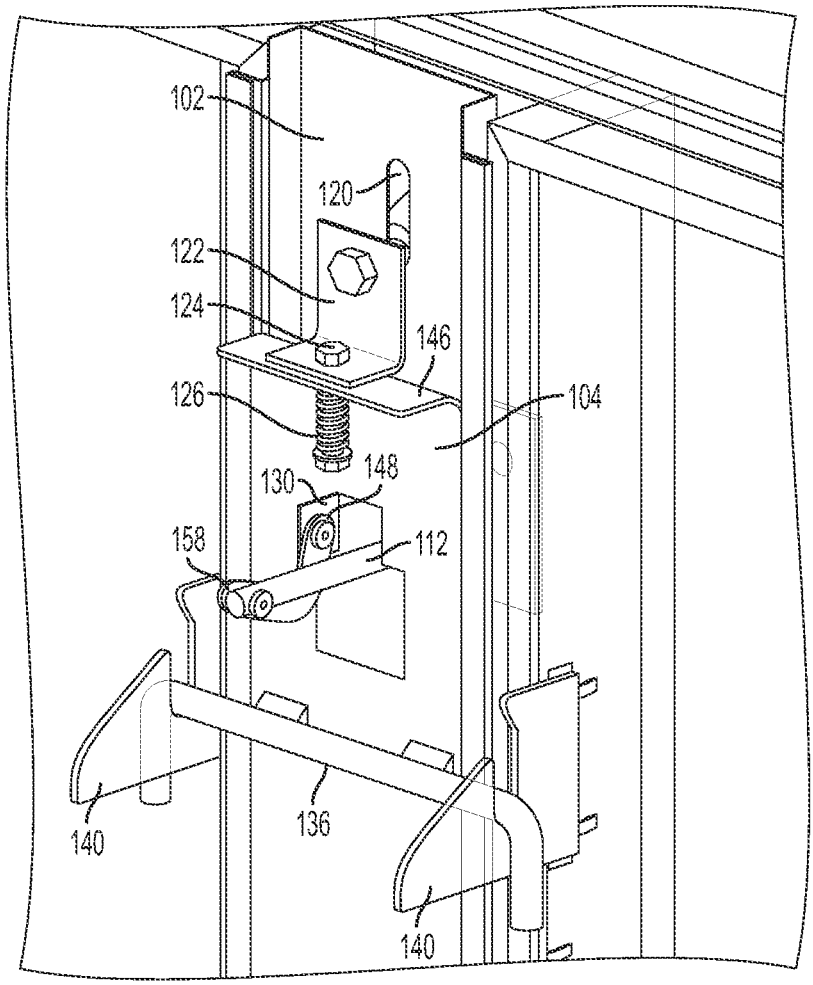
FIG. 4 illustrates a perspective view of the locking mechanism of FIG. 3 depicting securement with door catches of a storage box.

The spring 126 is disposed on the fastener 124. More specifically, as depicted in FIGS. 3 and 4, the spring 126 is disposed on the portion of the fastener 124 that is positioned below an upper lip 146 (shown in FIG. 4) of the sled 104. Additionally, at the bottom end of the fastener 124, a nut and washer assembly 128 is fitted for retaining the spring 126 on the fastener 124 and for preventing removal of the spring 126 from the fastener 124. In the unlocked configuration of the locking mechanism 100 and during an upward motion of the knob 106, the fastener 124 is adapted to move upward to facilitate lifting of the sled 104.

Figure 5:
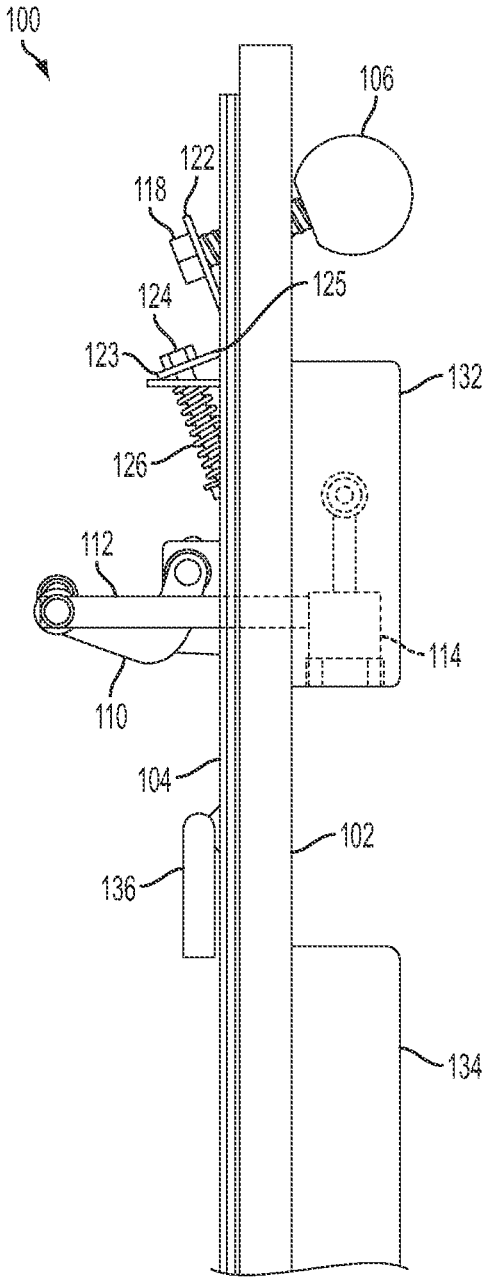
FIG. 5 illustrates a perspective view of the locking mechanism of FIG. 3 when the padlock is locked and the knob is actuated.

The bracket 122 and the sled 104 are connected to each other by the fastener 124 so that the sled 104 and the bracket 122 may move or slide with respect to each other. The relative sliding movement of the sled 104 with respect to the bracket 122 is facilitated by the spring 126. Additionally, in the locked configuration of the locking mechanism 100, any upward force on the knob 106 is absorbed by the spring 126 without corresponding movement of the sled 104. More particularly, as the knob 106 is moved in the upward direction, the fastener 124, the knob 106, and the bracket 122 pivot, as shown in FIG. 5, thus preventing the bracket 122, sled 104, and padlock 114 from being destroyed.

The cam 110 is coupled to the sled 104. A first end 148 of the cam 110 is connected to a raised lip 130 (shown in FIG. 4) of the sled 104 in a way such that the cam 110 is adapted to pivot along the first end 148. The other end 158 of the cam 110 is connected to the sled arresting element 112. The sled arresting element 112 is coupled to the cam 110 and adapted to pivot in accordance with movement of the cam 110 for facilitating locking and unlocking of the sled 104 and the locking mechanism 100. In one embodiment, the sled arresting element 112 is a horizontal rod. However, the present invention is not limited to any particular example of the sled arresting element 112.

Figure 6:
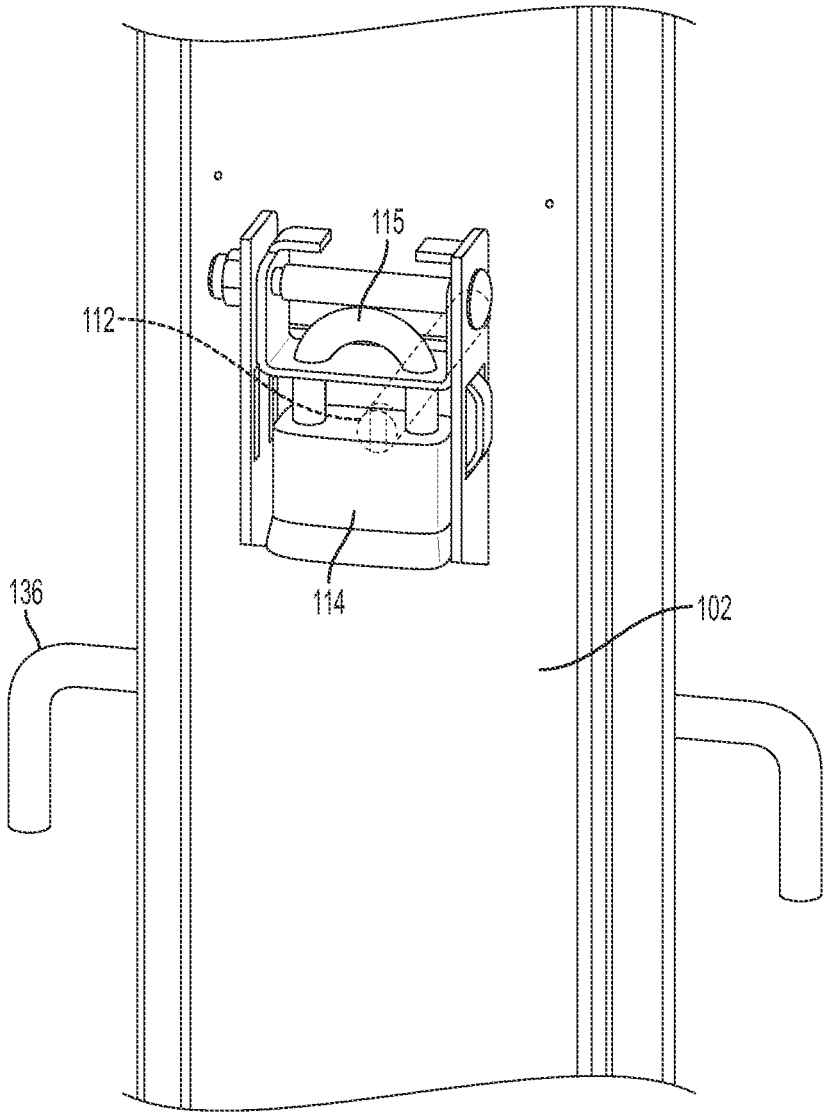
FIG. 6 illustrates a perspective view of a padlock of the locking mechanism of FIG. 3 depicting locked position of the padlock.

The padlock 114 is disposed on the center post 102 and adapted to removably lock the sled 104 with respect to the center post 102 by the sled arresting element 112 for facilitating locking and unlocking of the locking mechanism 100. Referring to FIG. 6, when the padlock 114 is in locked position, the body of the padlock 114 blocks the horizontal movement of the sled arresting element 112. In other words, in the locked position of the padlock 114, the body of the padlock 114 is positioned in front of the sled arresting element 112 and thereby prevents the movement of the sled arresting element 112. Accordingly, the sled 104 cannot move and the latch rod 136 and the doors 138 cannot be opened. Further, blocking of the movement of the sled arresting element 112 prevents movement of the sled 102 and thereby facilitates locking of the locking mechanism 100. The padlock 114 may be disposed in a housing or lock box 132 on the outside of the storage container. The padlock 114 is preferably positioned so that the key insertion surface of the padlock faces toward the bottom of the storage cabinet or in a downward direction.

Figure 7A:
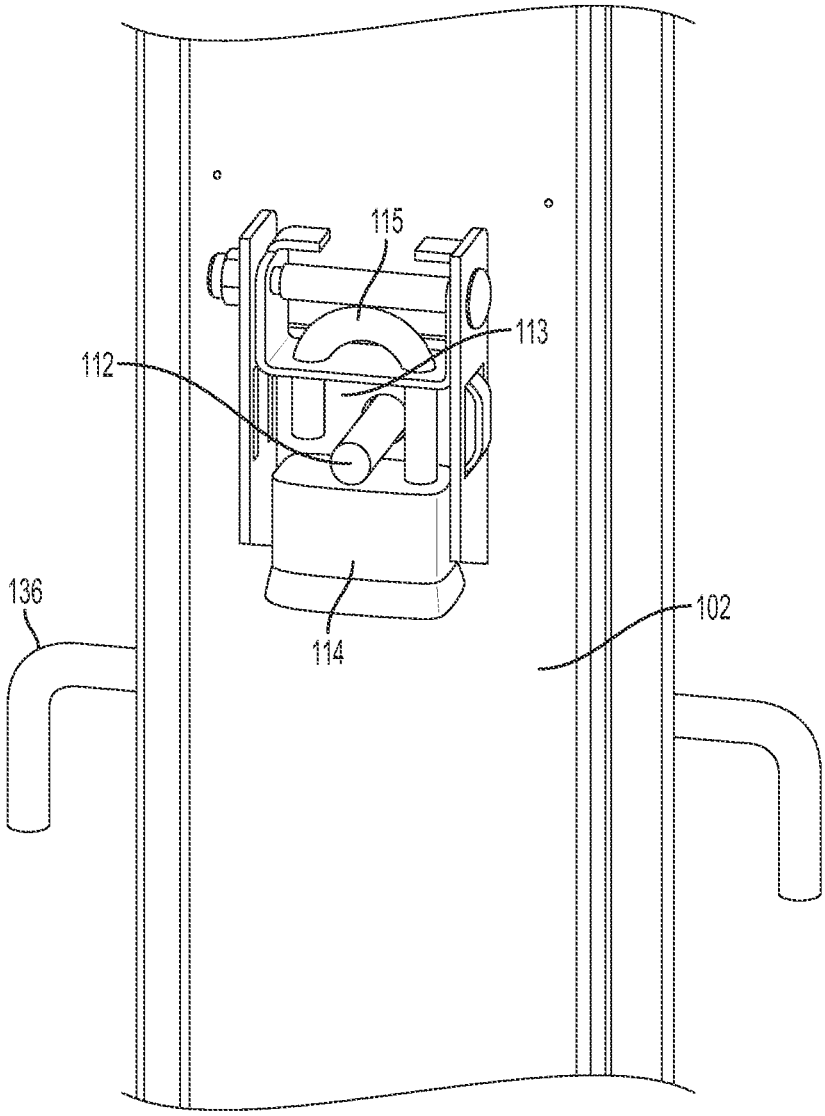
FIG. 7*a* illustrates a perspective view of the padlock of FIG. 6 depicting unlocked position of the padlock.
Figure 7B:
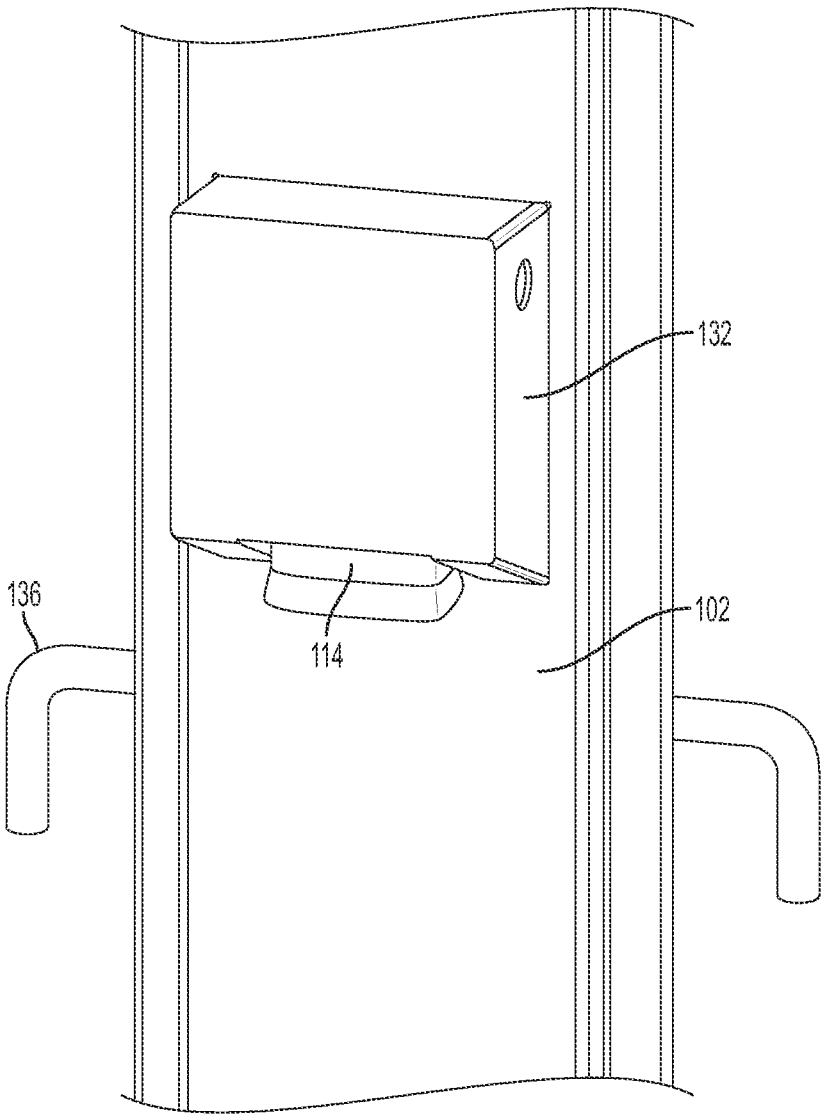
FIG. 7*b* illustrates a perspective view of the padlock of FIG. 7*a* depicting a lock box disposed on the padlock.

FIGS. 7*a* and 7*b* illustrate an unlocked position of the padlock 114. When the padlock 114 is unlocked, one end of a padlock shackle 115 is removed from a locking/unlocking hole (not shown) on the body of the padlock 114. Accordingly, due to the weight of the body of the padlock 114, the padlock 114 moves downward (due to gravity) and the sled arresting element 112 passes through a shackle loop 113 as the knob 106 is lifted upwards.

Figure 8:
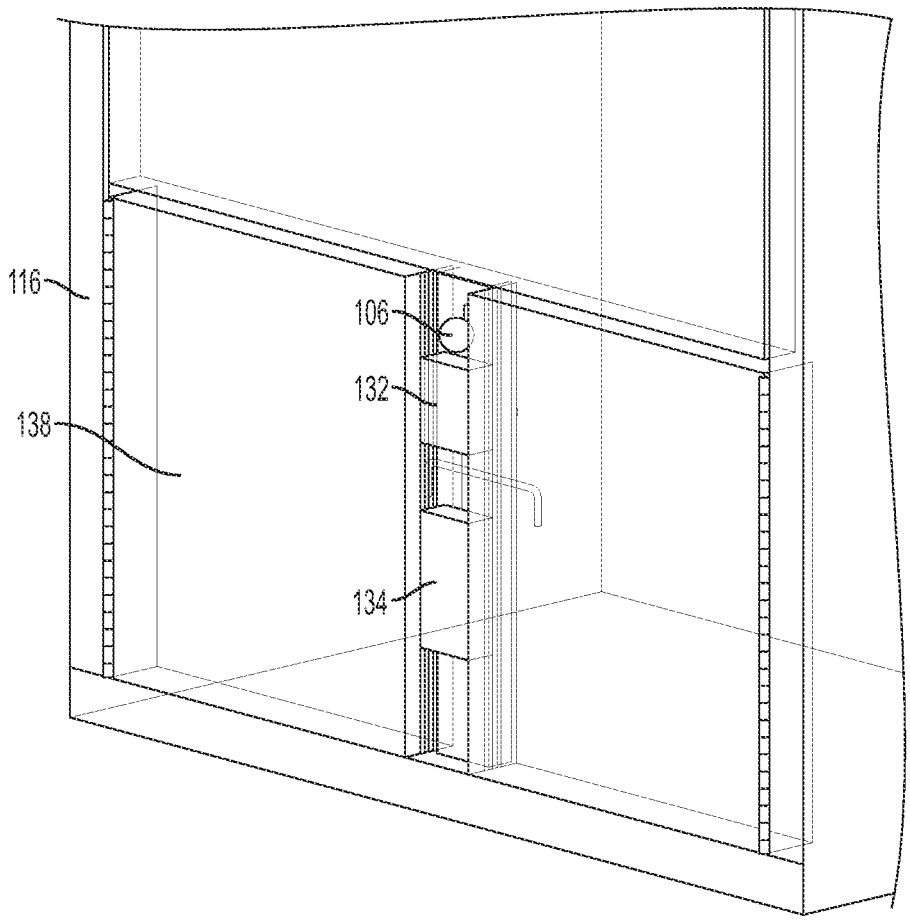
FIG. 8 illustrates a perspective view of a storage box containing the locking mechanism of FIG. 3.

Further, as shown in FIGS. 7*b* and 8, the locking mechanism 100 includes a cover 134 disposed on the center post 102 for precluding a drilling operation. More specifically, the cover 134 is disposed on the center post 102 in such a way that there is limited space between the center post 102 and the padlock 114. Accordingly, this limited space between the center post 102 and the padlock 114, as well as the vertical configuration of the locking mechanism 100 prevents a drill from being positioned to unlock the locking mechanism 100. The placement of the cover 134 and the vertical position of the padlock 114 restricts the space and does not allow for a drill to be vertically positioned between the cover 134 and the padlock 114 to drill out all tumblers of the padlock 114 at a straight vertical angle.

Furthermore, the locking mechanism 100 includes a latch rod 136 disposed on the sled 104. The latch rod 136 is adapted to facilitate removable locking of the sled 104 with a door 138 of the storage box 116. More specifically, the latch rod 136 is adapted to be removably secured to door catches 140 of the door 138, as shown in FIG. 4.

Figure 9:
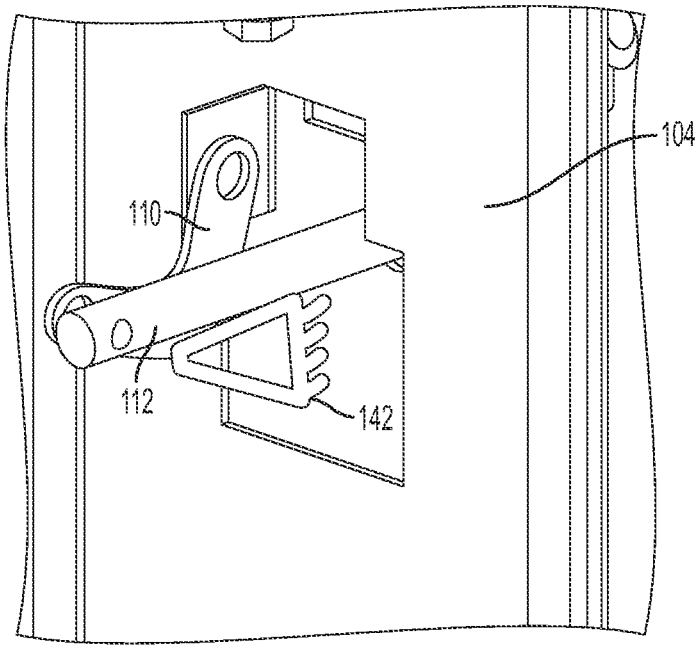
FIG. 9 illustrates a perspective view of a fixed pivot for preventing locking of a cam of the locking mechanism of FIG. 3 by an operative upward force.

Referring to FIG. 9, in one embodiment, the locking mechanism 100 includes a fixed pivot 142 for preventing locking of the cam 110. In the unlocked position of the padlock 114, as the sled 104 moves in upward direction, the cam 110 pivots with respect to the sled 104. The pivoting movement of the cam 110 moves the sled arresting element 112 horizontally. In the absence of the fixed pivot 142, as the sled 104 moves in upward direction, the sled arresting element 112 may move in an upward direction without pivoting the cam 110, thereby locking the movement of the cam 110 with respect to the sled arresting element 112. Thus, the fixed pivot 142 prevents the upward movement of the sled arresting element 112.

Figure 10:
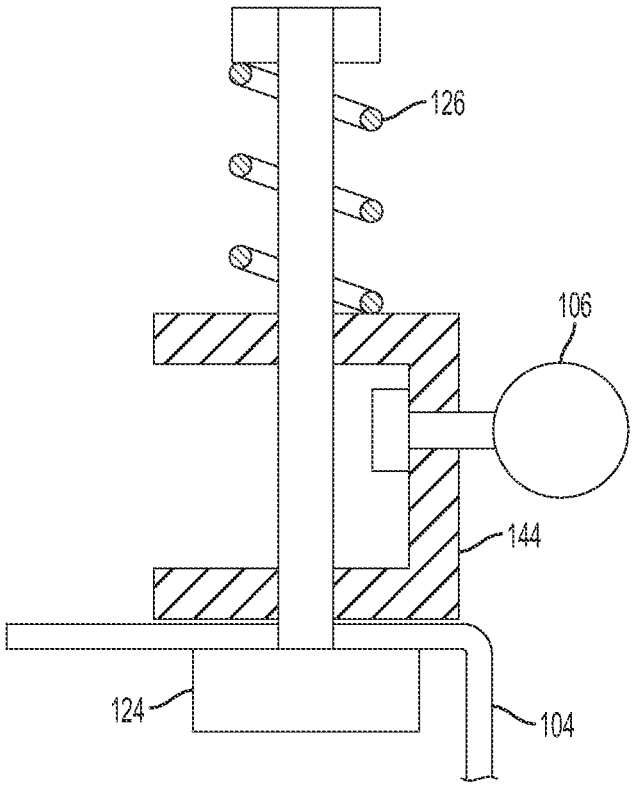
FIG. 10 illustrates a side view of connecting mechanism of the locking mechanism of FIG. 3, in accordance with another embodiment of the present invention.
Figure 11:
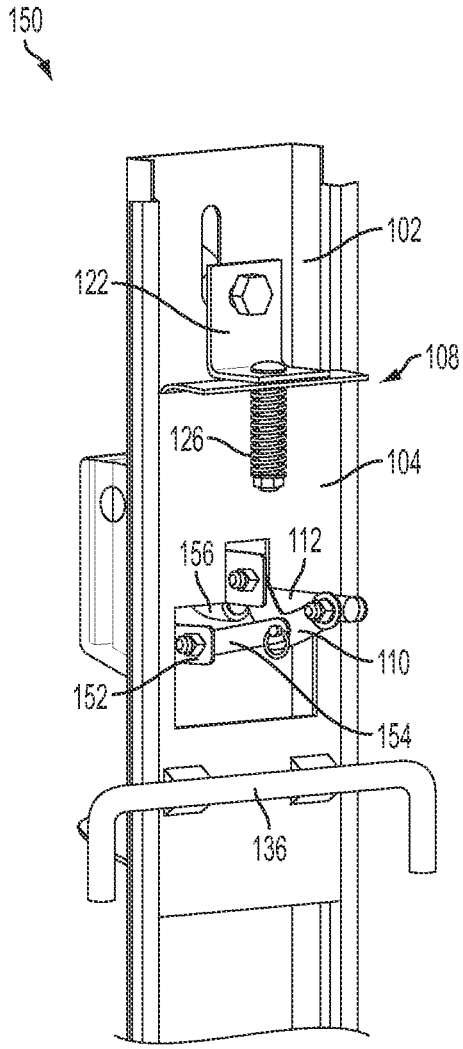
FIG. 11 illustrates a perspective view of a locking mechanism, in accordance with another embodiment of the present invention.
Figure 12:
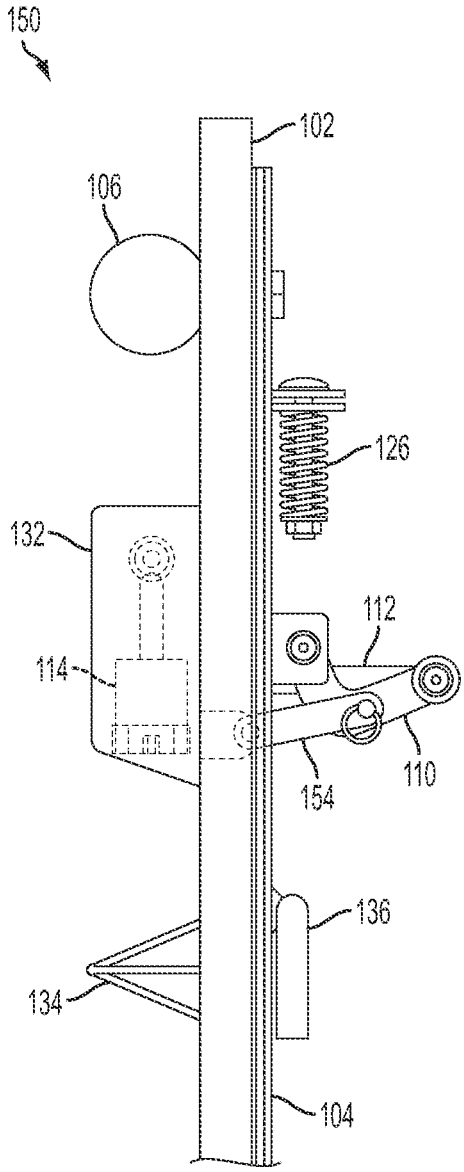
FIG. 12 illustrates a side view of the locking mechanism of FIG. 11.

Further, referring to FIG. 10, in one embodiment of the present invention, the L-shaped bracket 122 may be replaced by a C-shaped channel 144 for providing better control during actuation.

In use, to open the storage box 116, the padlock 114 is unlocked. Since the padlock 114 is unlocked (shown in FIGS. 7*a* and 7*b*), the body of the padlock 114 moves downward (due to gravity) and the sled arresting element 112 passes through the shackle loop 113 as the knob 106 is lifted upwards, or toward the top of the storage cabinet. The upward movement of the knob 106 lifts the fastener 124. As the fastener 124 is raised, due to relative sliding movement of the bracket 122 and sled 104 with respect to center post 102, the spring 126 absorbs the force applied to the knob. The force is then transferred to the sled 104 to lift the sled 104 upward, in the same direction as the knob 106. Further, since the cam 110 is connected to the sled 104, the cam 110 pushes the sled arresting element 112 in a horizontal or forward direction through the shackle loop 113 of the padlock shackle 115. At the same time, the latch rod 136 disposed on the sled 104 is lifted and clears the door catches 140. Thus, the doors 138 can be opened.

Further, when the padlock 114 is in a locked configuration (shown in FIG. 6), the body of padlock 114 blocks the horizontal movement of the sled arresting element 112. In other words, in the locked position of the padlock 114, the body of the padlock 114 is positioned in front of the sled arresting element 112 and thereby prevents the movement of the sled arresting element 112. Accordingly, the sled 104 cannot move and the latch rod 136 and the doors 138 can not be opened.

Referring to FIG. 5, blocking of the movement of the sled arresting element 112 prevents movement of the sled 102 and thereby facilitates locking of the locking mechanism 100. The knob 106 may be actuated even in the locked configuration of the padlock 114. However, the movement of the knob 106 is absorbed by the spring 126. More particularly, as the knob 106 is moved in the upward direction, the fastener 124 moves upward along with the knob 106 and the bracket 122. The bracket 122 pivots downwardly against the upper lip 146 of the sled 104 as the fastener 124 moves along with the knob 106. Due to the pivoting movement of the bracket 122, a first end 123 of the bracket 122 abuts the sled 104, and a second end 125 of the bracket 122 moves away from the sled 104. The spring 126 absorbs the force of the bracket 122 pushing on the upper lip 146. Thus, when the padlock 114 is in a locked configuration, any upward force applied to the knob 106 is absorbed by the spring 126 and is not transmitted to the bracket 122, sled 104, or padlock 114.

Referring to FIGS. 11 to 15, a locking mechanism 150 is described, in accordance with another embodiment of the present invention. The locking mechanism 150 is similar in structure to the locking mechanism 100, except for the addition of a bracket 152, a connecting link 154 and a guide bush 156. The bracket 152 is disposed on the center post 102. The connecting link 154 hingedly connects the cam 110 to the bracket 152. More specifically, one end of the connecting link 154 is pivotably connected to the bracket 152. Similarly, the other end of the connecting link 154 is pivotably connected to the cam 110. The other end of the connecting link 154 is pivotably connected to the cam 110 at a location in between the pivoting ends of the cam 110. The connecting link 154 is adapted to facilitate movement of the sled arresting element 112 by transferring the upward and downward movement of the sled 104 to the pivoting movement of the cam 110. The pivoting movement of the cam 110 is then transferred in to reciprocating motion of the connecting link 154.

The guide bush 156 (shown in FIGS. 11 and 15) is adapted to facilitate smooth operation of the locking mechanism 150. More specifically, the guide bush 156 prevents the sled arresting element 112 from falling out of the hole provided on the center post 102 by providing greater surface support.

Figure 13:
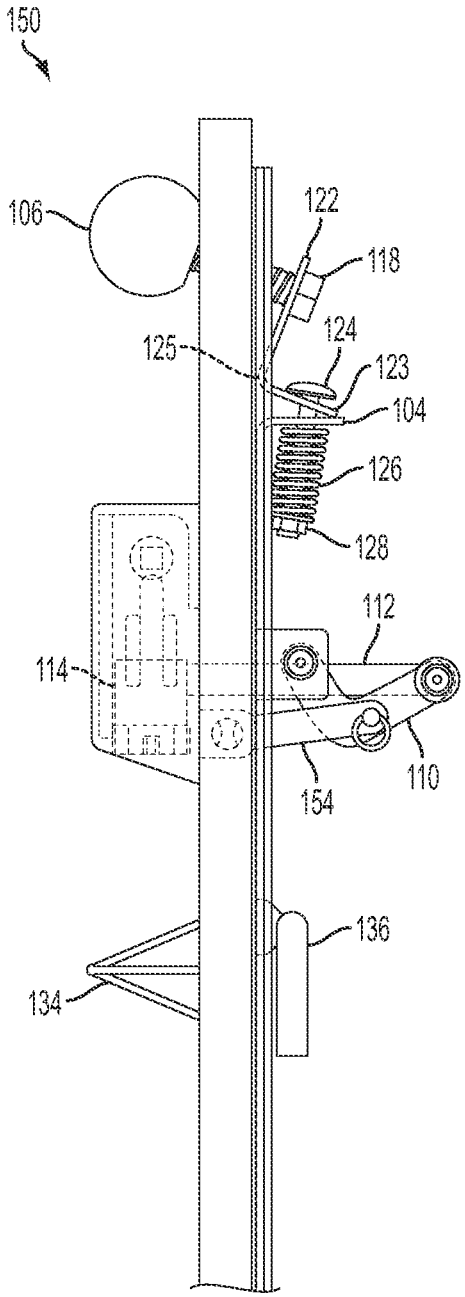
FIG. 13 illustrates a side view of the locking mechanism of FIG. 11 when the padlock is locked and the knob is actuated.

The locking mechanism 150 is further provided with a cover 134 (shown in FIGS. 12 to 14*b*) in accordance with another embodiment of the present invention. The cover 134 has a wedge-shaped structure, as shown in FIGS. 12 to 14*b*. The cover 134 is disposed on the center post 102 in such a way that there is limited space between the center post 102 and the padlock 114. Accordingly, this limited space between the center post 102 and the padlock 114, as well as the vertical configuration of the locking mechanism 150 prevents a drill from being positioned to unlock the locking mechanism 150. FIG. 13 illustrates the locking mechanism of FIG. 11 when the padlock 114 is locked and the knob 106 is actuated.

Figure 14A:
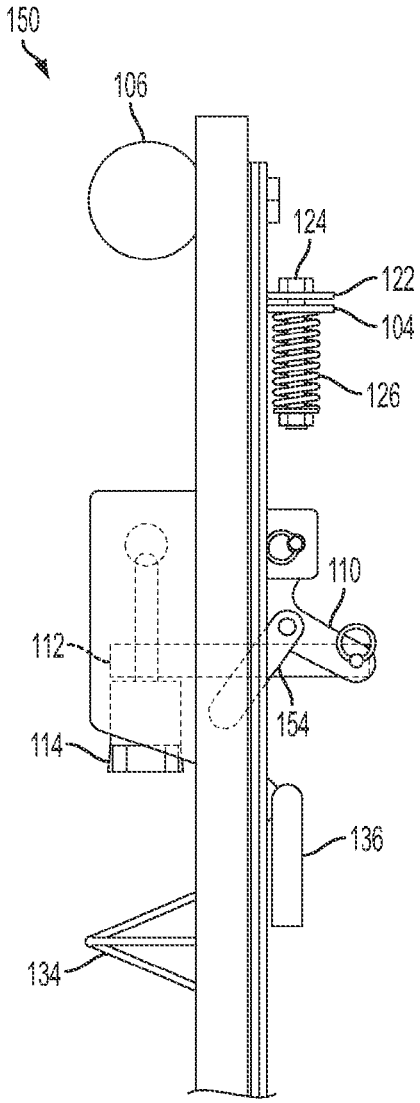
FIG. 14*a* illustrates a side view of the locking mechanism of FIG. 11 when the padlock is in unlocked position.
Figure 14B:
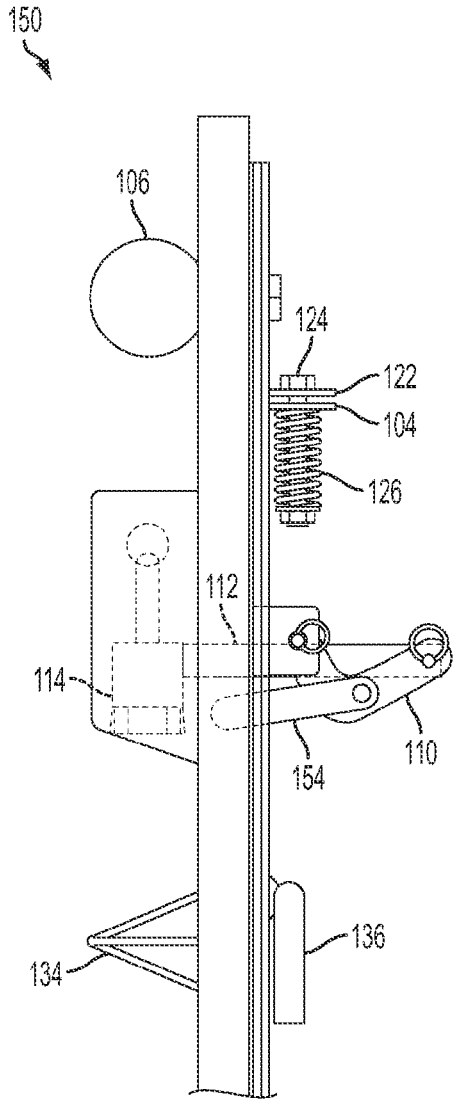
FIG. 14*b* illustrates a side view of the locking mechanism of FIG. 11 when the padlock is in locked position.
Figure 15:
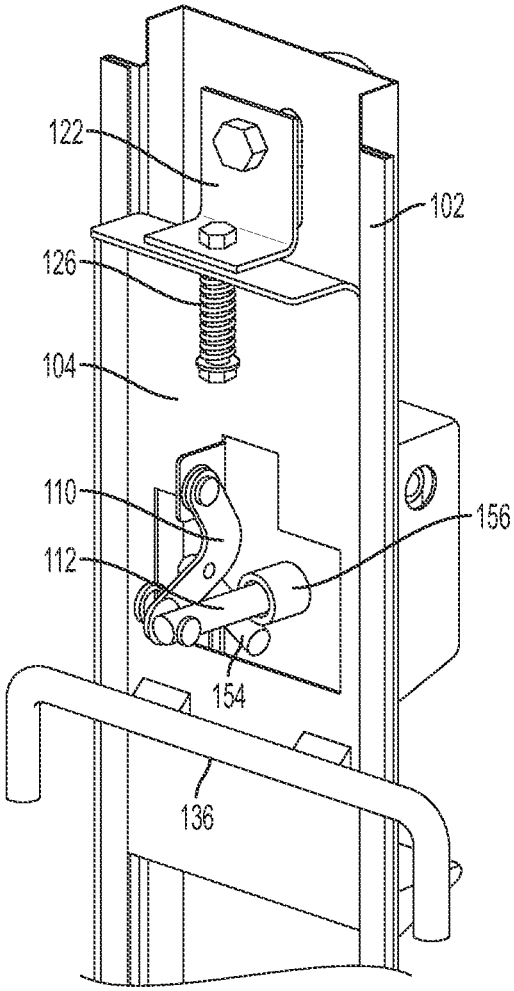
FIG. 15 illustrates a perspective view of the locking mechanism of FIG. 11 depicting a guide bush of the locking mechanism.

In use, to open the storage box 116, the padlock 114 is unlocked (shown in FIG. 14*a*). Since the padlock 114 is unlocked, one end of a padlock shackle 115 is removed from a locking/unlocking hole (not shown) on the body of the padlock 114. Accordingly, due to the weight of the body of the padlock 114, the padlock 114 moves downward (due to gravity) and the sled arresting element 112 passes through the shackle loop 113 as the knob 106 is lifted upwards, or toward the top of the storage cabinet. The upward movement of the knob 106 facilitates lifting of the fastener 124. As the fastener 124 is raised, due to relative sliding movement of the bracket 122 and sled 104 with respect to center post 102, the spring 126 absorbs the force applied to the knob. The force is then transferred to the sled 104 to facilitate lifting of the sled 104. Further, since the cam 110 is connected to the sled 104, the cam 110 pushes the sled arresting element 112 through the shackle loop 113 of the padlock shackle 115. At the same time, the latch rod 136 disposed on the sled 104 is lifted and clears the door catches 140. Thus, the doors 138 can be opened.

Further, when the padlock 114 is in a locked configuration (shown in FIG. 14*b*), the body of padlock 114 blocks the horizontal movement of the sled arresting element 112. In other words, in the locked position of the padlock 114, the body of the padlock 114 is positioned in front of the sled arresting element 112 and thereby prevents the movement of the sled arresting element 112. Accordingly, the sled 104 cannot move and the latch rod 136 and the doors 138 can not be opened.

Referring to FIG. 13, blocking of the movement of the sled arresting element 112 prevents movement of the sled 104 and thereby facilitates locking of the locking mechanism 150. The knob 106 may be actuated even in the locked configuration of the padlock 114. However, the movement of the knob 106 is absorbed by the spring 126. More particularly, as the knob 106 is moved in the upward direction, the fastener 124 moves upward along with the knob 106 and the bracket 122. The bracket 122 pivots downwardly against the upper lip 146 of the sled 104 as the fastener 124 moves along with the knob 106. Due to pivoting movement of the bracket 122, a first end 123 of the bracket 122 abuts to the sled 104 and a second end 125 of the bracket 122 moves away from the sled 104. The spring 126 absorbs the force of the bracket 122 pushing on the upper lip 146. Thus, when the padlock 114 is in a locked configuration, any upward force applied to the knob 106 is absorbed by the spring 126 and is not transmitted to the bracket 122, sled 104, or padlock 114.

Now referring to FIGS. 16 to 20, a locking mechanism 200 is disclosed, in accordance with another embodiment of the present invention. The locking mechanism 200 is disposed on a center post 202 of a storage container. The locking mechanism 200 includes a sled 204, an actuator or knob 206, a connecting mechanism 208, a sled arresting mechanism including a cam 210 and a sled arresting element 212, and a padlock 214. The center post 202, the sled arresting mechanism 212 and the padlock 214 are similar in structure and function to the center post 102, the sled arresting element 112 and the padlock 114 as depicted in FIGS. 3-4.

The sled 204 is slidingly disposed on the center post 202. The knob 206 is operatively coupled to the center post 202 and the sled 204. One end of the knob 206 is connected to a fixed pivot 216 and the other end of the knob 206 allows a user to move the knob 206 with respect to the fixed pivot 216. The knob 206 is adapted to actuate the sled 204 when the locking mechanism 200 is in an unlocked configuration.

The connecting mechanism 208 is coupled to the knob 206 and the sled 204. The connecting mechanism 208 is adapted to facilitate movement of the sled 204 on the center post 202 in an unlocked configuration of the locking mechanism 200. The connecting mechanism 208 includes a vertical rod 218, a nut and washer assembly 220 and a spring 222. The vertical rod 218 is operatively connected to the sled 204 and the knob 206. The vertical rod 218 has a stopper 224 (shown in FIG. 17) disposed at a lower end thereof. Due to upward movement of the vertical rod 218, the stopper 224 interacts with a receiver 233 of the sled 204, and thereby lifts the sled 204.

The vertical rod 218 is connected to the knob 206 at a location substantially away from the fixed pivot 216 of the knob. The spring 222 is disposed on a top end of the vertical rod 218. The nut and washer assembly 220 is disposed on the top end of the vertical rod above the spring 222. The spring 222 is positioned between the knob 206 and the nut and the washer assembly 220. More specifically, the spring 222 is disposed between a bracket 226 and the nut and the washer assembly 220. Additionally, as the knob 206 is lifted, the spring 222 absorbs the force applied to the knob 206. The spring 222 facilitates movement of the knob 206 without causing corresponding movement of the sled 204 during a locked configuration of the locking mechanism 200.

Figure 18:
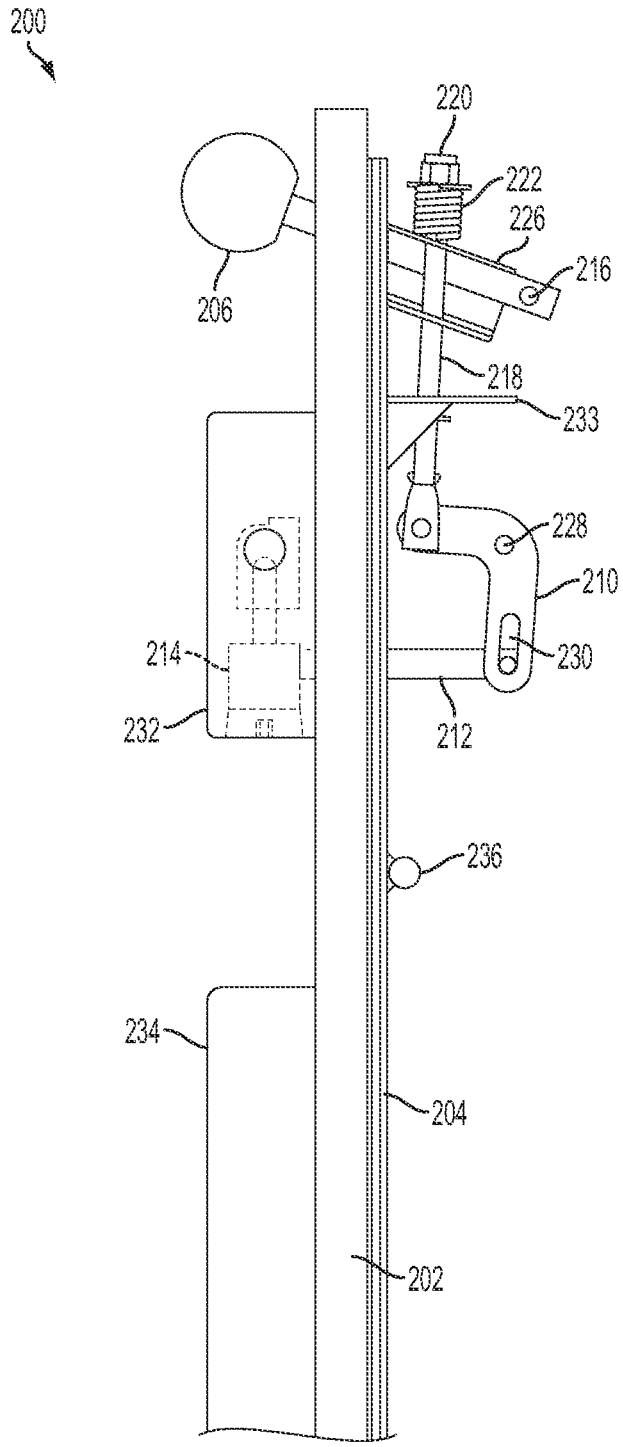
FIG. 18 illustrates a side view of the locking mechanism of FIG. 16 depicting locked position of the padlock.
Figure 19:
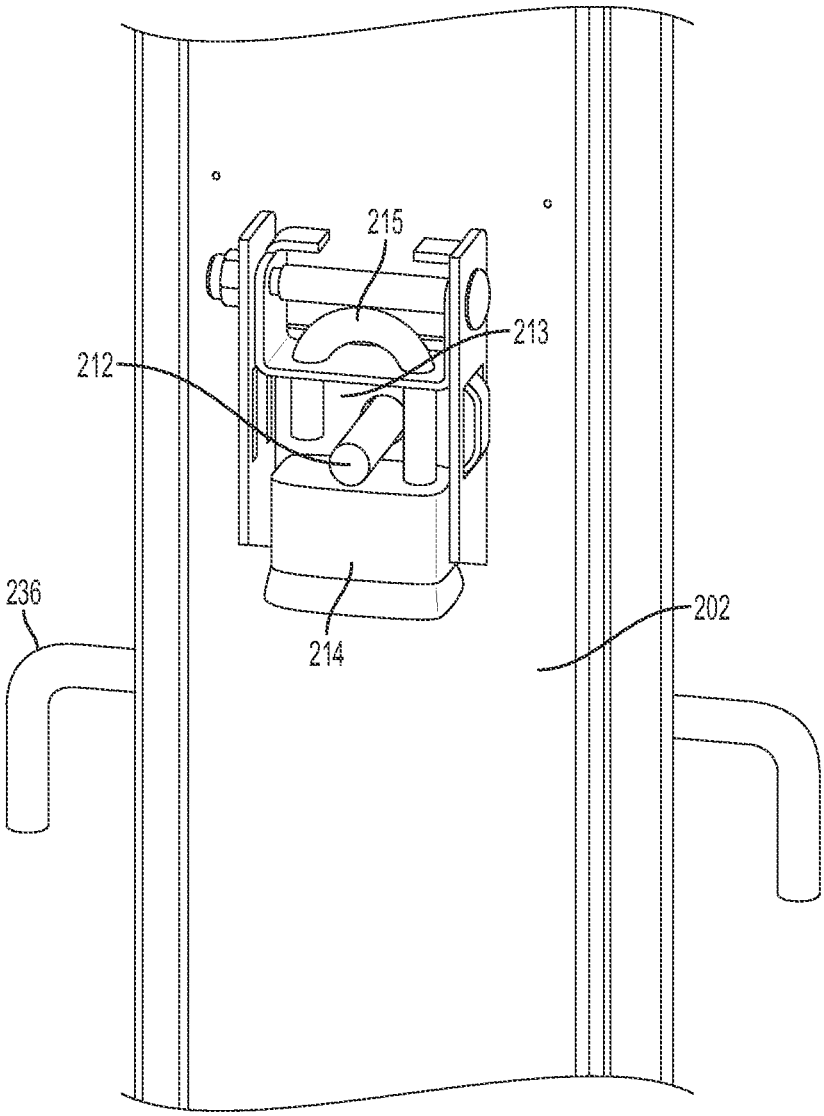
FIG. 19 illustrates a perspective view of the padlock of the locking mechanism of FIG. 16 depicting unlocked position of the padlock.
Figure 20:
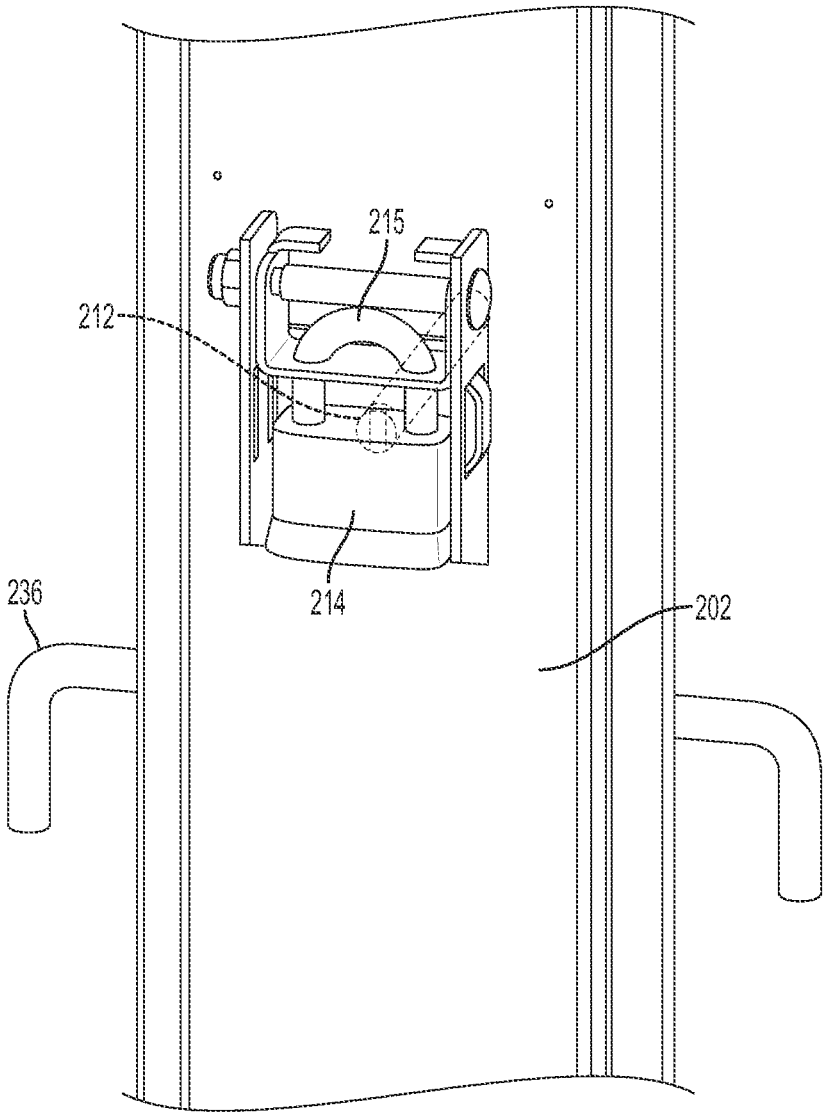
FIG. 20 illustrates a perspective view the padlock of the locking mechanism of FIG. 16 depicting locked position of the padlock.

Referring to FIG. 18, as the knob 206 is moved in the upward direction, the vertical rod 218 moves upward along with the knob 206 and the bracket 226. The spring 222 becomes compressed as the vertical rod 218 moves along with the knob 206.

The cam 210 is operatively coupled to the connecting mechanism 208 and the sled 204. More specifically, a top end of the cam 210 is connected to a lower end of the vertical rod 218. Further, the middle portion of the cam 210 is connected to a fixed pivot 228 and a lower end of the cam 210 is connected to the sled arresting element 212. The cam 210 is adapted to pivot with respect to the fixed pivot 228. More specifically, the lower end of the cam 210 includes a slot 230 for enabling motion of the sled arresting element 212 therein. The sled arresting element 212 is coupled to the cam 210 and adapted to move in accordance with movement of the cam 210 for facilitating locking and unlocking of the sled 204 and the locking mechanism 200.

In use, when the padlock 214 is in an unlocked configuration (shown in FIG. 19), one end of a padlock shackle 215 is removed from a locking/unlocking hole (not shown) on the body of the padlock 214. Accordingly, the weight of the body of the padlock 214 moves the padlock 214 downwards and the sled arresting element 212 passes through a shackle loop 213 as the knob 206 is lifted upwards. When the knob 206 is lifted the spring 222 absorbs the force applied to the knob 206. The upward movement of the knob 206 lifts the rod 218. As the cam 210 rotates about fixed pivot 228, the cam 210 pushes the sled arresting element 212 through the shackle loop 213 of the padlock shackle 215. As the vertical rod 218 is lifted, the stopper 224 located on the vertical rod 218 interacts with the receiver 233 and lifts the sled 204. As the sled 204 is lifted, the latch rod 236 disposed on the sled 204 is lifted and clears the door catches so the doors can be opened.

Further, when the padlock 214 is in a locked configuration (shown in FIG. 20), the body of the padlock 214 blocks the horizontal movement of the sled arresting element 212. In other words, in the locked position of the padlock 214, the body of the padlock 214 is positioned in front of the sled arresting element 212 and thereby prevents the movement of the sled arresting element 212. Accordingly, the sled 204 cannot move and the doors 138 cannot be opened. Further, blocking of the movement of the sled arresting element 212 prevents movement of the sled 202 and thereby facilitates locking of the locking mechanism 200. However, the knob 206 may still be rotated about the fixed pivot 216. This rotation of the knob 206 does not result in actuation of the cam 210 and the sled arresting element 212 because as the knob 206 is moved in the upward direction, the vertical rod 218 moves upward along with the knob 206 and the bracket 226. The spring 222 becomes compressed as the vertical rod 218 moves along the knob 206. Thus, in locked configuration of padlock 214, the force exerted by the knob 206 is absorbed by the spring 222 and the force is not transmitted to the sled 204 or padlock 214.

Figure 16:
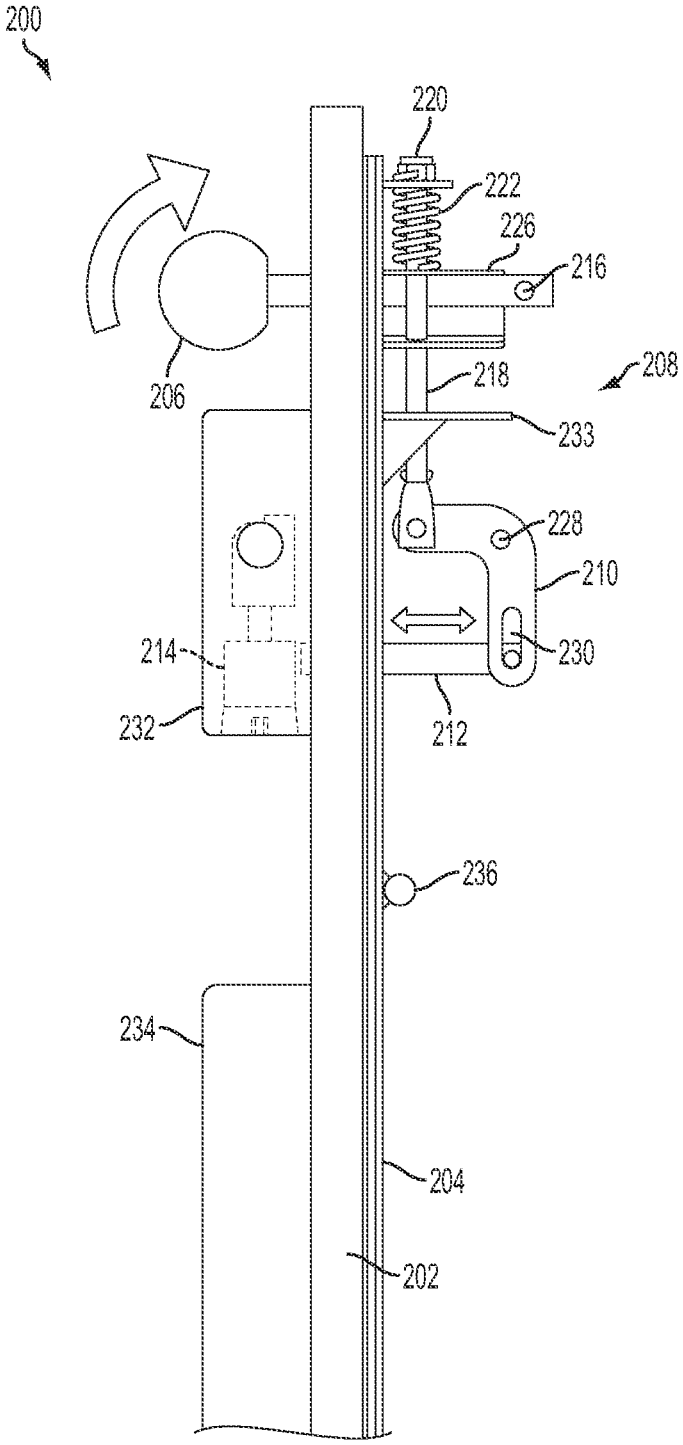
FIG. 16 illustrates a side view of a locking mechanism, in accordance with yet another embodiment of the present invention.
Figure 17:
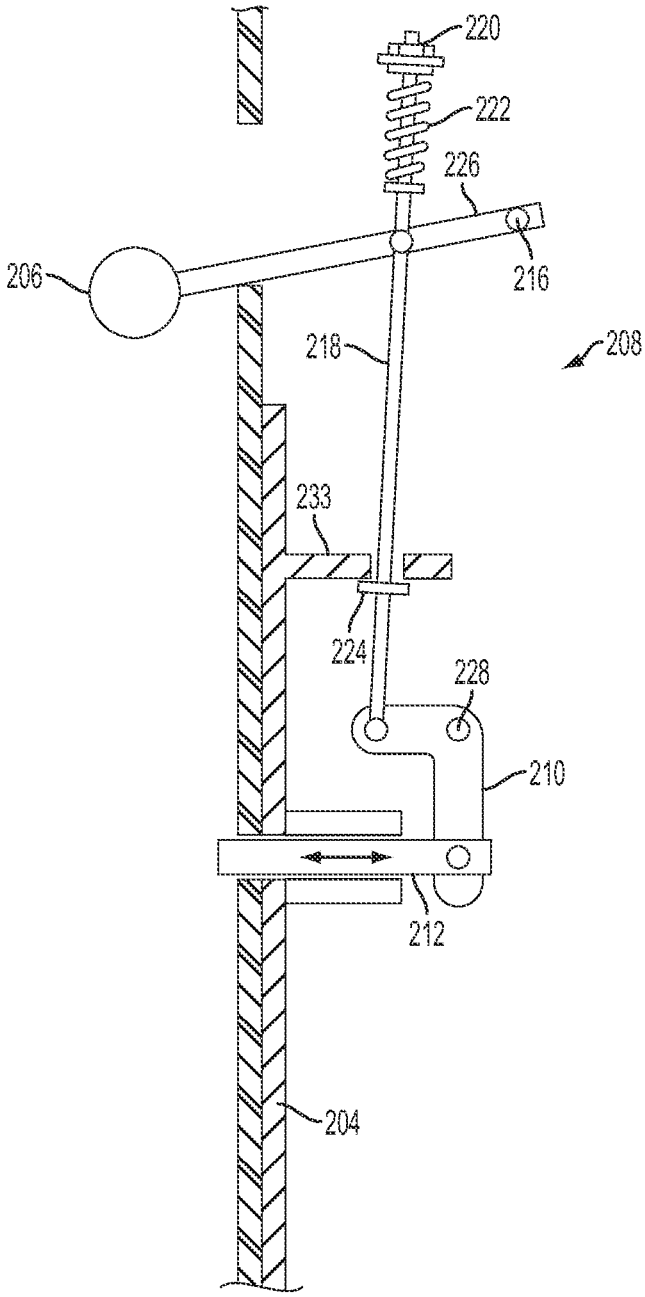
FIG. 17 illustrates a side view of connecting mechanism of the locking mechanism of FIG. 16.

FIGS. 16 to 18 also illustrate a lock box 232 and a latch rod 236. The lock box 232 is disposed on the center post 202 and adapted to contain the padlock 214 therein. The latch rod 236 facilitates removable locking of the sled 204 with a door of the storage box. More specifically, the latch rod 236 is adapted to be removably secured to door catches of the door of the storage box.

Figure 21:
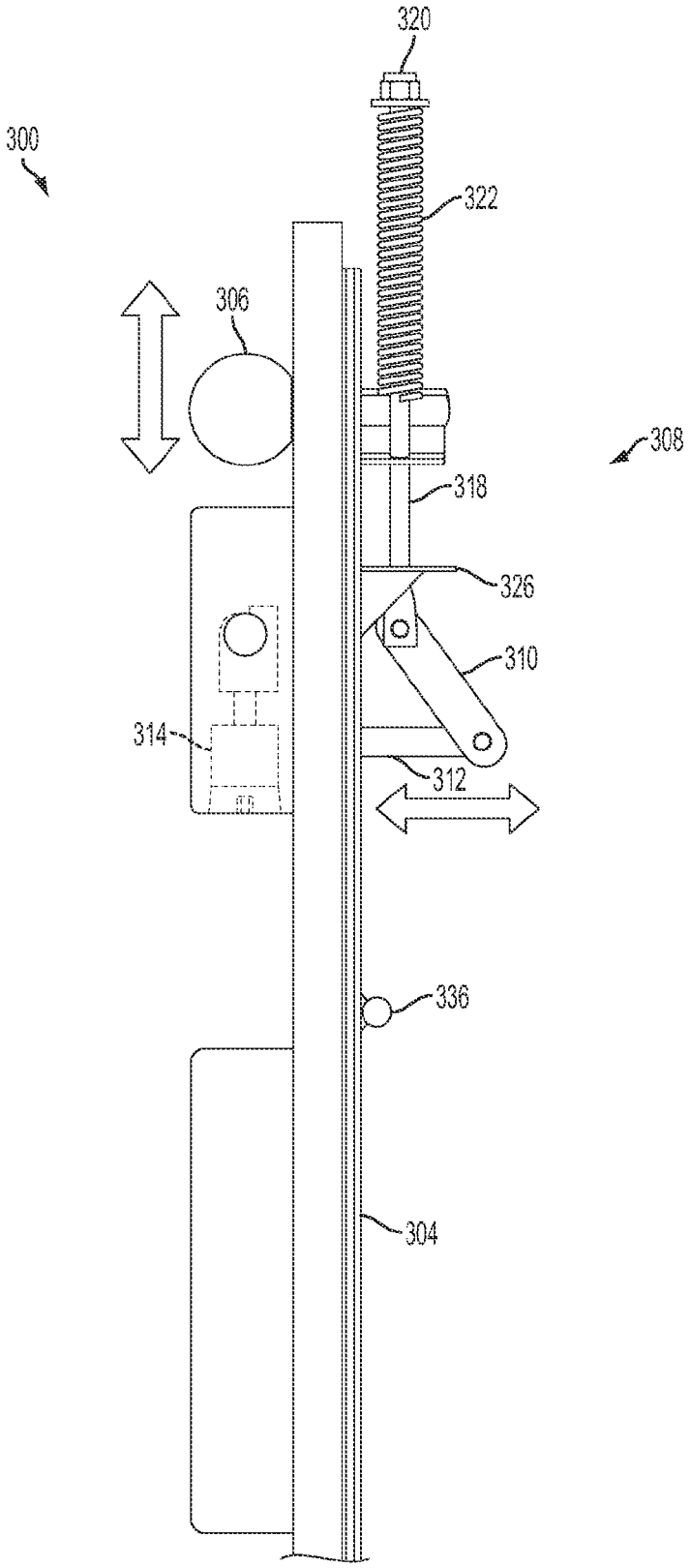
FIG. 21 illustrates a side view of a locking mechanism, in accordance with yet another embodiment of the present invention.
Figure 22:
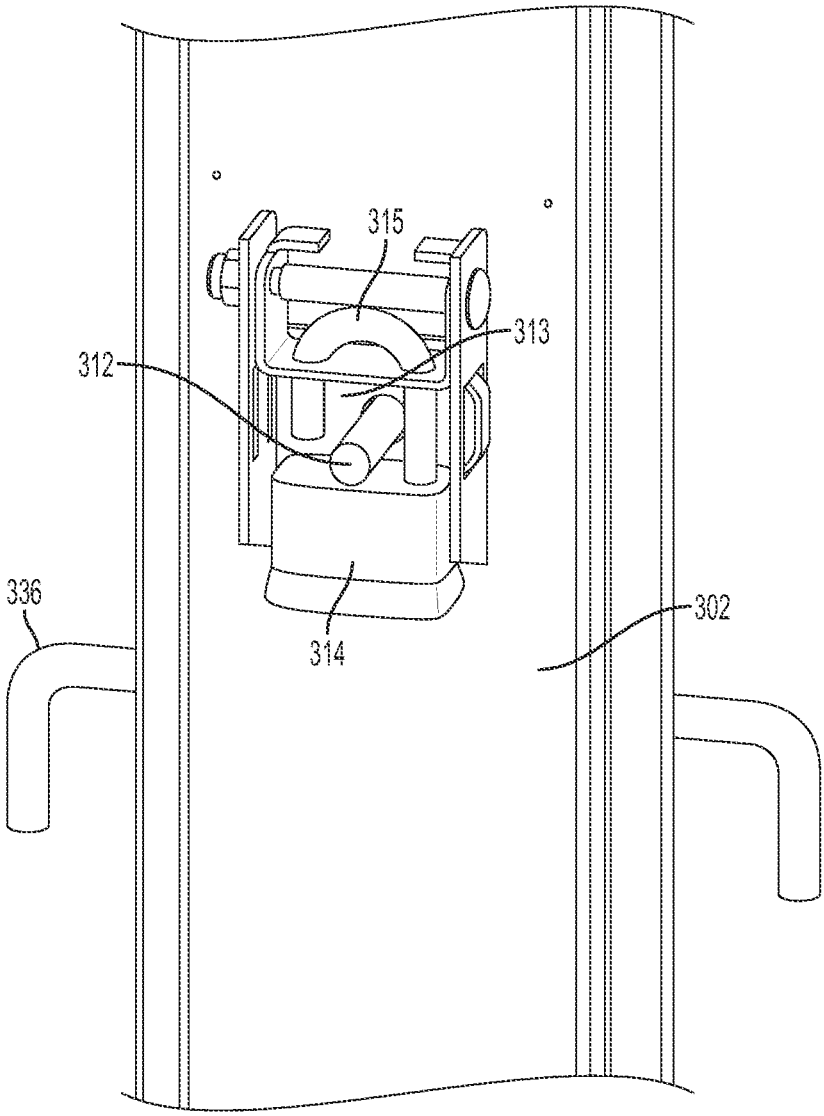
FIG. 22 illustrates a perspective view of the padlock of the locking mechanism of FIG. 21 depicting unlocked position of the padlock.
Figure 23:
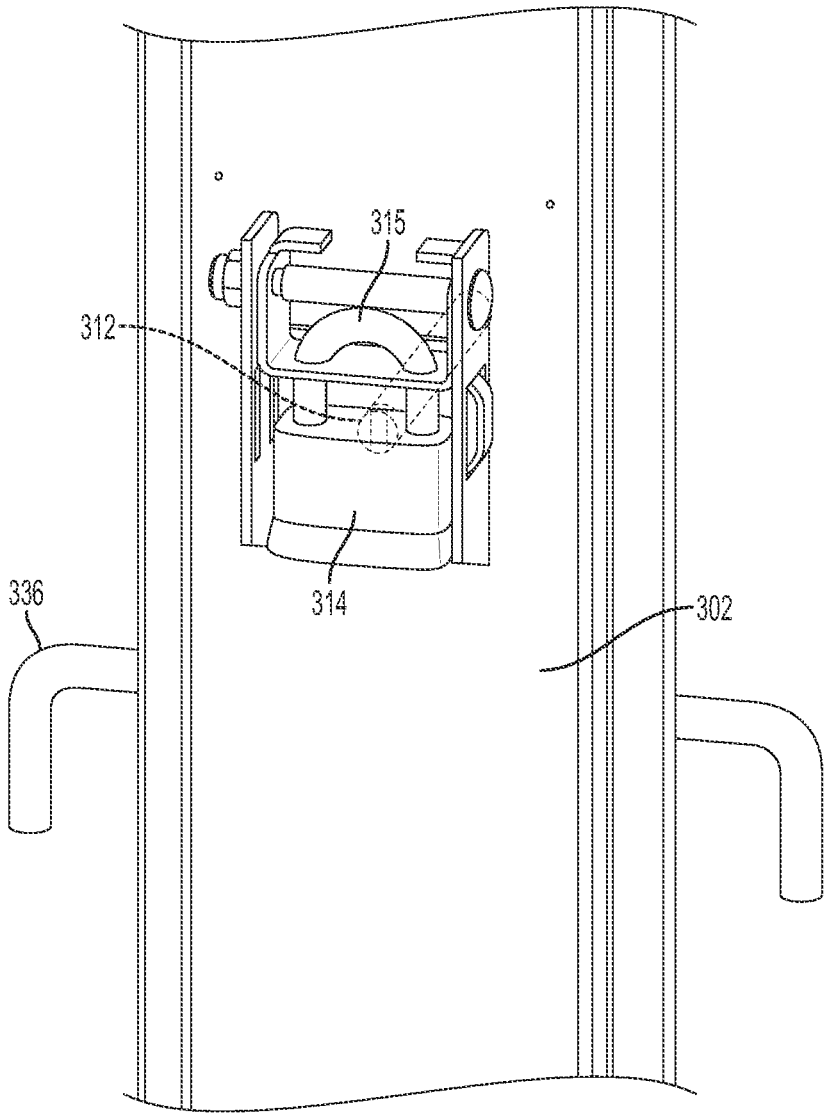
FIG. 23 illustrates a perspective view of the padlock of the locking mechanism of FIG. 21 depicting locked position of the padlock.

Referring to FIGS. 21 to 23, a locking mechanism 300 is disclosed, in accordance with another embodiment of the present invention. The locking mechanism 300 is disposed on a center post 302 of a storage container. The locking mechanism 300 is similar in structure and function to the locking mechanism 200, except with respect to actuator or knob 306, connecting mechanism 308 and cam 310.

The knob 306 is adapted to enable a reciprocating motion, i.e. vertically upward and downward motion, instead of a pivoting motion. The connecting mechanism 308 includes a vertical rod 318, a nut and washer assembly 320 and a spring 322. The vertical rod 318 is operatively connected to the sled 304 and the knob 306. The vertical rod 318 has a stopper (not shown) disposed at a lower end thereof. Due to upward movement of the vertical rod 318, the stopper interacts with a receiver (not shown) of the sled 304 and thereby lifts the sled 304. The vertical rod 318 is connected to the knob 306 at a location substantially away from a free end of the knob 306. The spring 322 is disposed on the vertical rod 318. The nut and washer assembly 320 is disposed on a top end of the vertical rod 318 above the spring 322, wherein the spring 322 is disposed between the knob 306 and the nut and the washer assembly 320.

The cam 310 is operatively coupled to the connecting mechanism 308 and the sled 304. More specifically, a top end of the cam 310 is connected to a lower end of the vertical rod 318 and a lower end of the cam 310 is connected to the sled arresting element 312. In this embodiment, cam 310 is a straight cam.

In use, when the padlock 314 of the locking mechanism 300 is in an unlocked configuration (shown in FIG. 22), one end of a padlock shackle 315 is removed from a locking/unlocking hole (not shown) on the body of the padlock 314. Accordingly, due to the weight of the body of the padlock 314, the padlock 314 moves downward (due to gravity) and the sled arresting element 312 passes through a shackle loop 313 as the knob 306 is lifted upwards. When the knob 306 is lifted, the spring 322 absorbs the force applied to the knob 306. The upward movement of the knob 306 lifts the rod 318. The upward movement of the rod 318 causes the cam 310 to push the sled arresting element 312 through the shackle loop 313 of the padlock shackle 315. As the vertical rod 318 is lifted, the stopper (not shown) located on the vertical rod 318 interacts with a receiver of the sled 304 and lifts the sled 304. As the sled 304 is lifted, a latch rod 336 disposed on the sled 304 is lifted and clears door catches so the doors can be opened.

Further, when the padlock 314 is in a locked configuration (shown in FIG. 23), the body of the padlock 314 blocks the horizontal movement of the sled arresting element 312. In other words, in the locked position of the padlock 314, the body of the padlock 314 is positioned in front of the sled arresting element 312 and thereby prevents the movement of the sled arresting element 312. Accordingly, the sled 304 cannot move and the doors 138 cannot be opened. Further, blocking of the movement of the sled arresting element 312 prevents movement of the sled 304 and thereby facilitates locking of the locking mechanism 300. However, the knob 306 may still be lifted. This lifting of the knob 306 does not result in actuation of the cam 310 and the sled arresting element 312 because as the knob 306 is moved in the upward direction, the vertical rod 318 moves upward along with the knob 306. The spring 322 becomes compressed as the vertical rod 318 moves along the knob 306. Thus, in locked configuration of padlock 314, the force exerted by the knob 306 is absorbed by the spring 322 and the force is not transmitted to the sled 304 and padlock 314.

Figure 24:
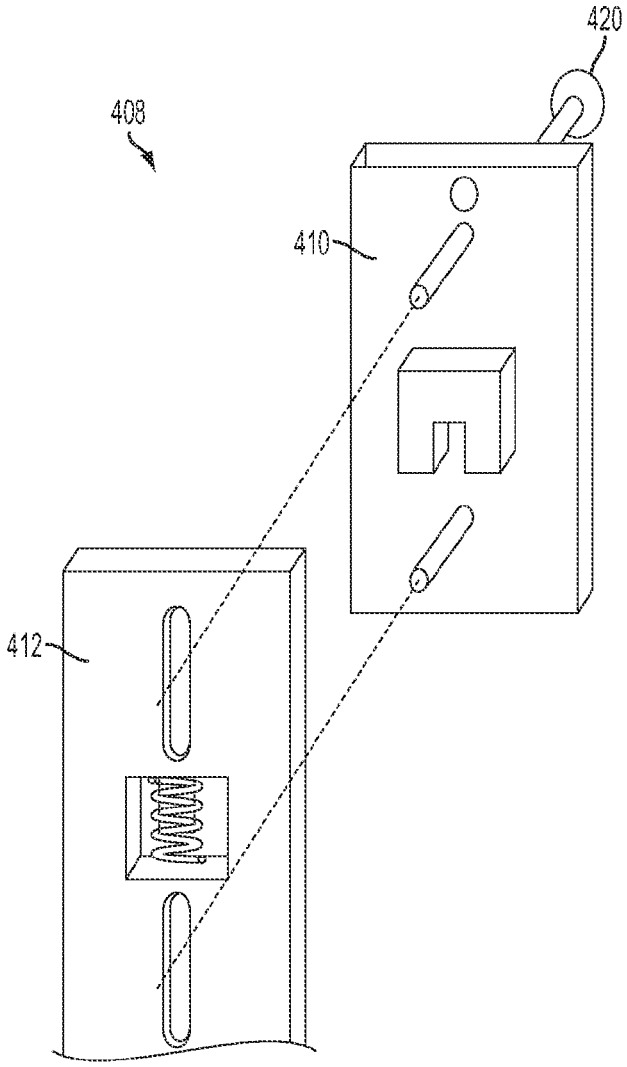
FIG. 24 illustrates a side view of a spring loaded plate as connecting mechanism for the locking mechanism of FIG. 21.
Figure 25:
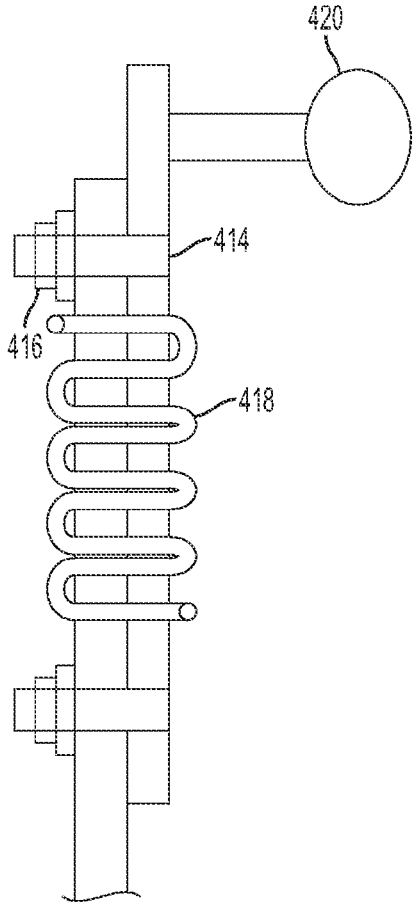
FIG. 25 illustrates an exploded view of the connecting mechanism of FIG. 24.

Referring to FIGS. 24 and 25, a spring loaded plate 408 is depicted as the connecting mechanism. The spring loaded plate 408 includes a knob plate 410, a sled 412, weld studs 414, flat washers 416, a spring 418, and a knob 420. The spring 418 may be installed between the sled 412 and the knob plate 410. The weld studs 414 are adapted to be installed in the knob plate 410 and adapted to ride in slots provided in the sled 412 for ensuring alignment.

In the unlocked position of a padlock of a locking mechanism, such as the locking mechanisms 100, 200 and 300, as the knob 420 is lifted, the upward movement of the knob 420 lifts the sled 412. Further, when the padlock is in a locked configuration, the knob 420 may still be lifted by means of elongated openings 422 configured on the sled 412 and by expansion of the spring 418. However, this lifting of the knob 420 does not result in the upward movement of the sled 412 as the upward movement of the knob 420 is absorbed by the spring 418.

The locking mechanisms described above are resistant to drill attack due to vertical configuration of the locking mechanisms and the positioning of a cover on a center post. Further, the locking mechanisms preclude application of positive force on a padlock by an actuation knob in a locked configuration of the padlock, as external force applied on the actuation knob is absorbed by the spring of the locking mechanism and thereby prevents the transmission of such force to the sled and padlock. Still further, the locking mechanisms are easy to use and provide improved security. Additionally, the locking mechanisms provide a user with a quick visual inspection of the locking mechanisms to determine a locked or an unlocked configuration of the locking mechanisms. Due to the vertical configuration of the locking mechanisms, the padlock is not visible to a user in the locked configuration, and the padlock is visible in the unlocked configuration.

While considerable emphasis has been placed herein on the particular features of this invention, it will be appreciated that various modifications can be made, and that many changes can be made in the preferred embodiments without departing from the principles of the invention. These and other modifications in the nature of the invention or the preferred embodiments will be apparent to those skilled in the art from the disclosure herein, whereby it is to be distinctly understood that the foregoing descriptive matter is to be interpreted merely as illustrative of the invention and not as a limitation.

The invention claimed is:

1. A locking mechanism for use in a storage container, the storage container including a center post, the locking mechanism comprising:

an actuator coupled to the center post, the actuator being capable of moving the locking mechanism from a locked position where access to the storage container is prevented to an unlocked position in which access to the storage container is allowed;

a sled disposed on the center post and operatively coupled to the actuator;

a connecting mechanism for connecting the actuator to the sled;

a lock positioned on the center post, the lock capable of being locked and unlocked; and a sled arresting mechanism operatively coupled to the sled and allowing movement of the sled on the center post when the lock is unlocked;

wherein when the lock is unlocked and the actuator is moved in a vertical direction, the sled moves in the same direction as the actuator, thereby moving the sled arresting mechanism in a horizontal direction toward the lock, which causes the latch rod to unlock the storage container.

2. The locking mechanism of claim 1 wherein the connecting mechanism includes a bracket coupled to the actuator, a fastener connecting the bracket to the sled, and a spring disposed on the fastener.

3. The locking mechanism of claim 2 wherein any force applied to the actuator in the locked position is absorbed by the spring.

4. The locking mechanism of claim 1 wherein the sled arresting mechanism includes a cam secured to a sled arresting element.

5. The locking mechanism of claim 1 wherein the lock is a padlock having a shackle and a lock body, the lock body including a key insertion surface, and the key insertion surface facing a downward direction.

6. The locking mechanism of claim 5 wherein the padlock is positioned within a housing on the outside of the storage container.

7. The locking mechanism of claim 5 wherein in the unlocked position, the sled arresting element passes through a shackle loop of the padlock as the actuator is lifted in a vertical direction.

8. The locking mechanism of claim 5 wherein in the locked position, the lock body of the padlock body blocks any movement of the sled arresting element.

9. The locking mechanism of claim 1 further comprising a cover disposed on the center post to prevent access to the lock.

10. The locking mechanism of claim 7 wherein the cover is positioned below the lock on the center post.

11. The locking mechanism of claim 1 further comprising a latch rod disposed on the sled, the latch rod engaging with door catches on the storage container.

12. The locking mechanism of claim 1 further comprising a guide bush surrounding the sled arresting element.

13. A locking mechanism for use in a storage container, the storage container including a center post, the locking mechanism having an unlocked configuration in which the storage container can be opened and a locked configuration in which the storage container cannot be opened, the locking mechanism comprising:

a sled slidingly disposed on the center post;

an actuator coupled to the center post and to the sled, the actuator adapted to actuate the sled in the unlocked configuration of the locking mechanism;

a connecting mechanism for connecting the actuator to the sled, the connecting mechanism including a bracket coupled to the actuator, a fastener connecting the bracket to the sled, and a spring disposed on the fastener;

a cam coupled to the sled;

a padlock positioned on the center post, the padlock having a shackle and a key insertion surface, and the padlock capable of being locked and unlocked;

a sled arresting element secured to the cam, the sled arresting element allowing sliding movement of the sled on the center post when the padlock is unlocked; and a latch rod disposed on the sled, the latch rod being configured to engage with door catches on the storage container in the locked configuration of the storage container;

wherein when the padlock is locked, the sled arresting element prevents movement of the sled, thereby preventing the actuator from moving the locking mechanism to the unlocked configuration, and when the padlock is unlocked, the sled arresting element allows movement of the sled, thereby allowing the actuator to move the locking mechanism to the unlocked configuration.

14. The locking mechanism of claim 13 wherein the key insertion surface of the padlock faces a downward direction.

15. The locking mechanism of claim 13 wherein the padlock is positioned within a housing on the outside of the storage container.

16. The locking mechanism of claim 13 further comprising a cover disposed on the center post at a position below the padlock to prevent access to the padlock.

17. The locking mechanism of claim 13 wherein any force applied to the actuator in the locked configuration is absorbed by the spring.

18. A storage container having a center post, a floor, upright side walls, a rear wall extending upwardly from the floor, and a ceiling attached to the side walls and rear wall, the floor, side walls, rear wall, and ceiling define a storage cavity, the storage container further including a locking mechanism, the locking mechanism comprising:

an actuator coupled to the center post, the actuator being capable of moving the locking mechanism from a locked position where access to the storage container is prevented to an unlocked position in which access to the storage container is allowed;

a sled disposed on the center post and operatively coupled to the actuator;

a connecting mechanism for connecting the actuator to the sled;

a lock positioned within a housing on the center post;

a sled arresting mechanism operatively coupled to the sled and allowing movement of the sled on the center post when the lock is unlocked; and a cover positioned on the center post to prevent access to the lock;

wherein when the lock is locked, the sled arresting mechanism prevents movement of the sled, thereby preventing the actuator from moving the locking mechanism to the unlocked position, and when the lock is unlocked, the sled arresting mechanism allows movement of the sled, thereby allowing the actuator to move the locking mechanism to the unlocked position.

19. The storage container of claim 18 wherein the lock is a padlock having a shackle and a lock body, the lock body including a key insertion surface, and the key insertion surface facing a downward direction.

20. The storage container of claim 18 wherein the cover is located below the lock on the center post.

21. The storage container of claim 18 wherein the connecting mechanism includes a bracket coupled to the actuator, a fastener connecting the bracket to the sled, and a spring disposed on the fastener.

22. The storage container of claim 21 wherein any force applied to the actuator in the locked configuration is absorbed by the spring.

23. A lock system for a container with a closure which is moveable between locked and unlocked positions, the container including a center post, the lock system utilizing a lock having a body with a key insertion surface facing a downward direction, and a shackle, the lock system comprising:

an actuator coupled to the center post, the actuator being capable of moving the lock system from a locked position where access to the container is prevented to an unlocked position in which access to the container is allowed;

a sled slidingly disposed on the center post and operatively coupled to the actuator;

a connecting mechanism for connecting the actuator to the sled, the connecting mechanism including a bracket coupled to the actuator and a fastener connecting the bracket to the sled; and a sled arresting mechanism operatively coupled to the sled and allowing sliding movement of the sled on the center post when the lock is in the unlocked position;

wherein when the lock is locked, the sled arresting mechanism prevents movement of the sled, thereby preventing the actuator from moving the lock system to the unlocked position, and when the lock is unlocked, the sled arresting mechanism allows movement of the sled, thereby allowing the actuator to move the lock system to the unlocked position.

24. The locking mechanism of claim 23 wherein the connecting mechanism further comprises a spring disposed on the fastener.

25. The locking mechanism of claim 24 wherein any force applied to the actuator in the locked position is absorbed by the spring.

26. The locking mechanism of claim 23 wherein the sled arresting mechanism includes a cam secured to a sled arresting element.

27. The locking mechanism of claim 23 further comprising a cover disposed on the center post at a position below the padlock to prevent access to the lock.

28. The locking mechanism of claim 23 wherein the lock comprises a padlock.

* * * * *